US008092247B2

(12) United States Patent
Chien

(10) Patent No.: US 8,092,247 B2
(45) Date of Patent: Jan. 10, 2012

(54) POWER PLUG STRUCTURE

(75) Inventor: Ming-Fu Chien, Taipei (TW)

(73) Assignee: Longwell Company, Taipei (TW)

( * ) Notice: Subject to any disclaimer, the term of this patent is extended or adjusted under 35 U.S.C. 154(b) by 47 days.

(21) Appl. No.: 12/793,377

(22) Filed: Jun. 3, 2010

(65) Prior Publication Data

US 2011/0269342 A1 Nov. 3, 2011

(30) Foreign Application Priority Data

Apr. 30, 2010 (TW) ..... 99207996 U

(51) Int. Cl.
*H01R 13/627* (2006.01)

(52) U.S. Cl. ..... 439/359

(58) Field of Classification Search ..... 439/359, 439/311, 320, 347, 364, 373
See application file for complete search history.

(56) References Cited

U.S. PATENT DOCUMENTS 6,369,320 B1 * 4/2002 Okamoto ..... 174/50
7,140,902 B2 * 11/2006 Burton ..... 439/347
7,833,037 B2 * 11/2010 Reusche et al. ..... 439/271
7,892,003 B2 * 2/2011 Reusche et al. ..... 439/271
7,980,881 B2 * 7/2011 Furio et al. ..... 439/364
2007/0243750 A1 * 10/2007 Gallardo ..... 439/373

* cited by examiner

*Primary Examiner* — Tulsidas C Patel
*Assistant Examiner* — Phuongchi Nguyen
(74) *Attorney, Agent, or Firm* — Muncy, Geissler, Olds & Lowe, PLLC

(57) ABSTRACT

A power plug structure is provided. The present invention includes a loop inductor, a top cover, a bottom cover, a terminal holder, a metal shell and a cable. The top cover and the bottom cover are vertically engaged with each other to form a space to accommodate the loop inductor. The terminal holder has a plate and a group of press-fit holes penetrating the plate. An upper press-fit hook of the top cover and a lower press-fit hook of the bottom cover are inserted into the press-fit holes from the rear side of the terminal holder to press-fit with the plate. The metal shell shelters the top cover and bottom cover. The cable has a plurality of wires respectively electrical connecting with wire grippers of the top cover. The abovementioned power plug structure is easy to assemble and has a wave-filtering function and a reliable structure.

14 Claims, 8 Drawing Sheets

POWER PLUG STRUCTURE

BACKGROUND OF THE INVENTION

1. Field of the Invention

The present invention relates to a power plug structure, particularly to a power plug structure with high reliability.

2. Description of the Related Art

The daily-life, industrial electronic and electric devices are powered by alternating current, and the alternating current comes from a cable and a power plug connected with a power socket. Because of lacking a wave filter, many conventional power plugs lack an anti-noise function and an anti-electromagnetic interference function. In such a case, impulse current may cause early damage and a high failure rate. Although some conventional power plugs are equipped with a wave filter, the overall performance thereof is still inferior because of the following factors, including structural defects and insufficient protection of the rectifier unit.

SUMMARY OF THE INVENTION

One objective of the present invention is to provide a power plug structure, wherein a top cover and a bottom cover are press-fitted to encase a loop inductor, and the integrated top cover and bottom cover are further press-fitted with a terminal holder, whereby the loop inductor is effectively protected, and the present invention is easy to assemble and has a reliable structure.

To achieve the abovementioned objective, one embodiment of the present invention proposes a power plug structure, which comprises a loop inductor, a top cover, a bottom cover, a terminal holder, a metal shell and a cable. The loop inductor has a hollow portion. The top cover and the bottom cover are vertically engaged in a press-fit way to form a space to accommodate the loop inductor. At least one wire gripper and an upper press-fit hook respectively extend out from two laterals of the top cover. A lower press-fit hook extends out from a lateral of the bottom cover. The upper press-fit hook and the lower press-fit hook are arranged vertically. The openings of the upper and lower press-fit hooks are arranged in a face-to-face way or a back-to-back way. The terminal holder has a plate. A plurality of electric-conduction terminals protrudes from the front face of the plate. At least one positioning member is formed in the rear face of the plate and extends out with an angle existing between the plate and the positioning member. A group of press-fit holes penetrates the plate. The top cover and the bottom cover are pushed toward the plate from the rear face of the plate to insert the upper and lower press-fit hooks into the group of press-fit holes and secure the top and bottom covers to the plate. The metal shell wraps the top and bottom covers with the front face of the plate of the terminal holder being exposed. The cable has a plurality of wires, and each wire is electrically connected with an arbitrary one of the wire grippers.

Below, the embodiments of the present invention are described in detail in cooperation with the attached drawings to make easily understood the objectives, technical contents, characteristics and accomplishments of the present invention.

DETAILED DESCRIPTION OF THE INVENTION

The embodiments of the present invention are described in detail below. However, the embodiments are only to exemplify the present invention but not intended to limit the scope of the present invention.

Figure 1:
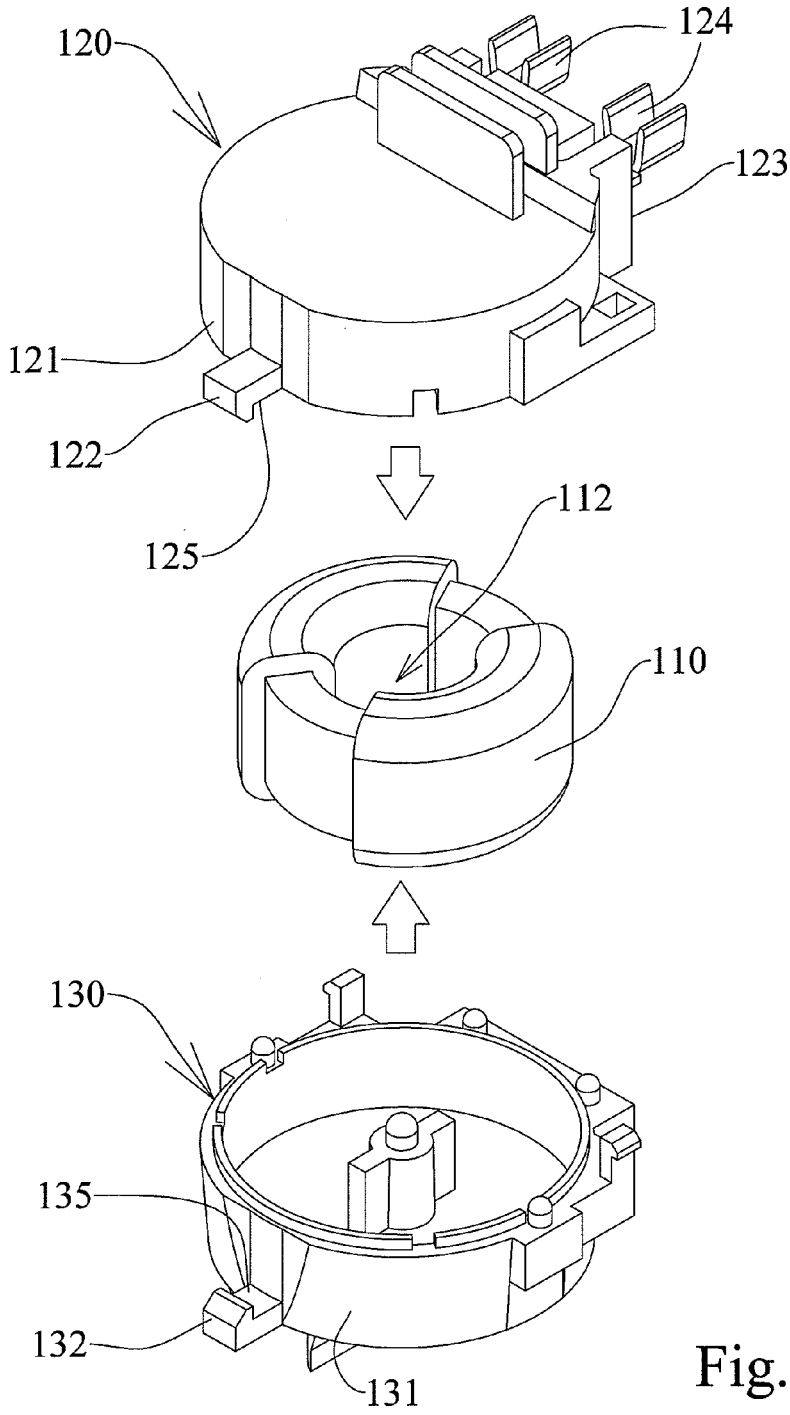
FIG. 1, FIG. 2A, FIG. 2B, FIG. 3 and FIG. 4 are diagrams schematically showing the assemblage of a power plug structure according to one embodiment of the present invention.

Refer to FIG. 1, FIG. 2A, FIG. 2B, FIG. 3, and FIG. 4 diagrams schematically showing the assemblage of a power plug structure according to one embodiment of the present invention. As shown in FIG. 1, the power plug structure comprises a loop inductor 110 having a hollow portion 112. The loop inductor 110 may be formed via winding two independent coils on a magnetic ring, wherein the two independent coils have identical winding number but are respectively wound in opposite directions. A top cover 120 and a bottom cover 130 are vertically engaged in a press-fit way to form a space to accommodate the loop inductor 110. An upper press-fit hook 122 and at least one wire gripper 124 respectively extend out from two laterals of the top cover 120. In this embodiment, the upper press-fit hook 122 and the wire gripper 124 respectively extend out from a front side 121 and a rear side 123 of the top cover 120. A lower press-fit hook 132 extends out from a lateral of the bottom cover 130. In this embodiment, the lower press-fit hook 132 extends out from a front side 131 of the bottom cover 130. The upper press-fit hook 122 and the lower press-fit hook 132 are corresponding to each other in the vertical direction. The opening 125 of the upper press-fit hook 122 and the opening 135 of the lower press-fit hook 132 are arranged in a face-to-face way or a back-to-back way. In this embodiment, the opening 125 of the upper press-fit hook 122 and the opening 135 of the lower press-fit hook 132 are arranged in a face-to-face way.

Figure 2A:
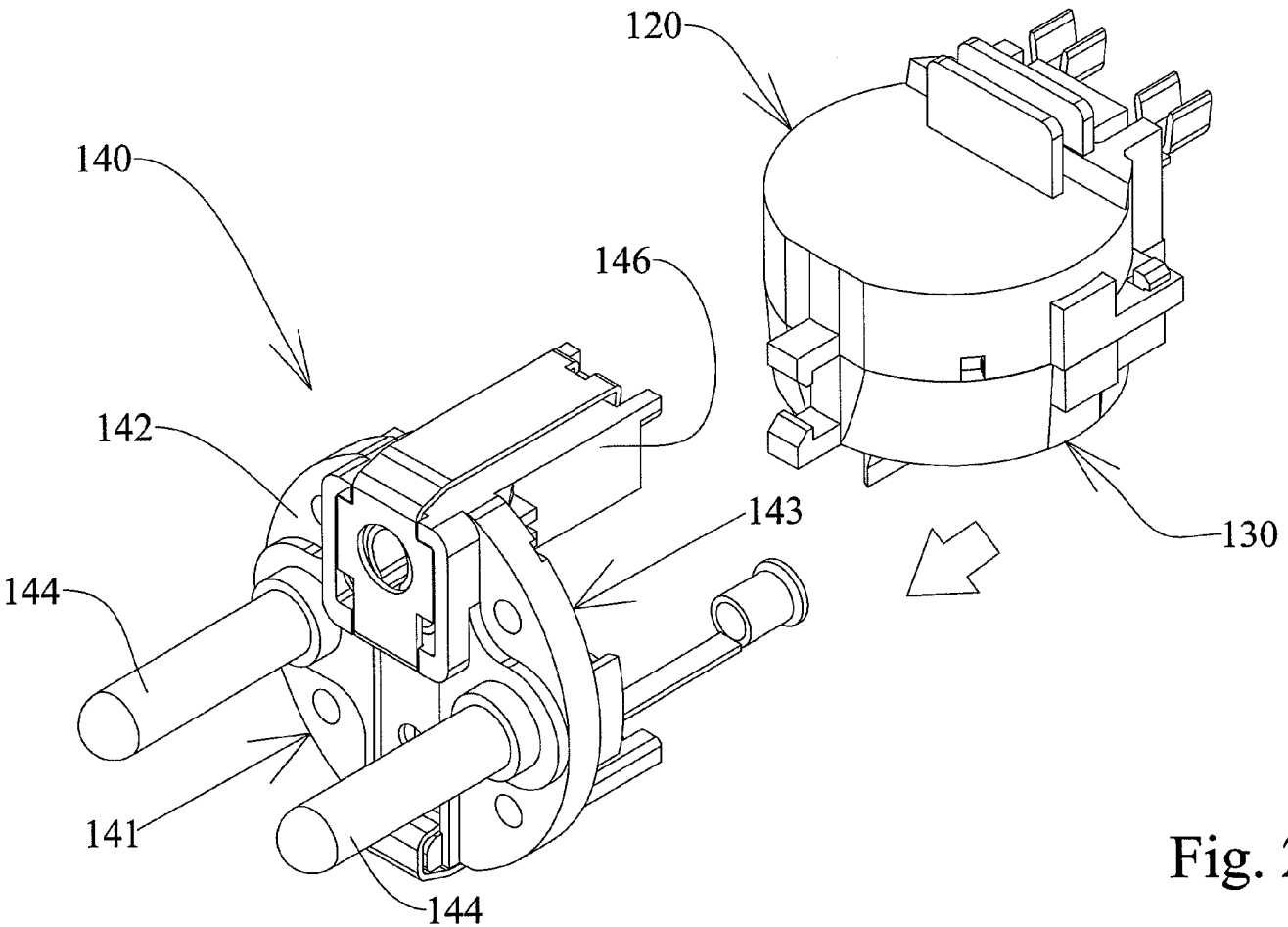
Figure 2B:
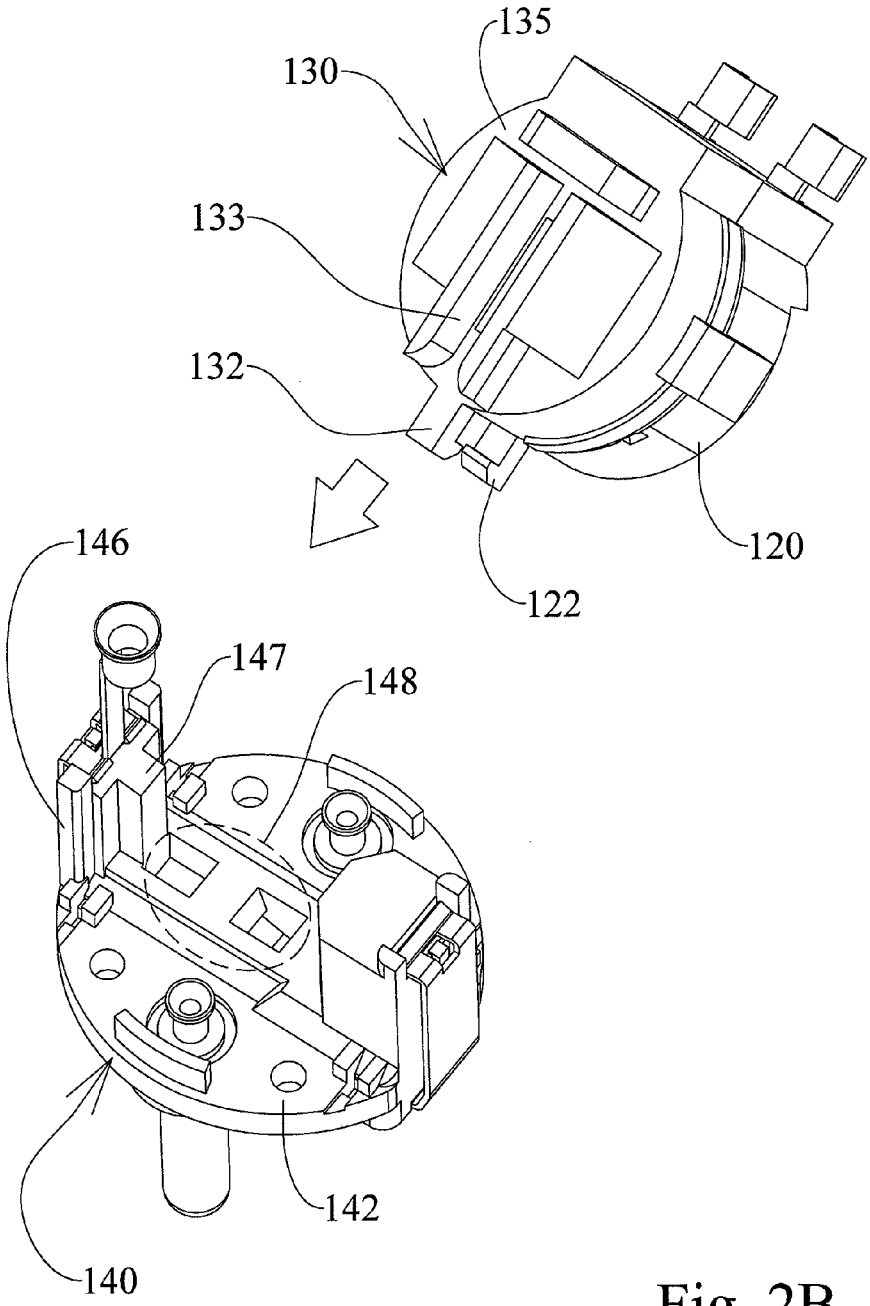

Refer to FIGS. 2A and 2B. FIG. 2B is a diagram schematically showing the assemblage of the power plug structure from another viewing angle. The power plug structure of the present invention further comprises a terminal holder 140 having a plate 142. A plurality of electric-conduction terminals 144 protrudes from a front face 141 of the plate 142. At least one positioning member 146 is formed on a rear face 143 of the plate 142 and extends out from the plate 142 with an angle existing between the positioning member 146 and the plate 142. As shown in FIG. 2B, a group of press-fit holes 148 penetrates the plate 142. The upper press-fit hook 122 of the top cover 120 and the lower press-fit hook 132 of the bottom cover 130 are inserted into the press-fit holes 148 from the rear face 143 of the plate 140 to press-fit with the press-fit holes 148. As long as the press-fit holes 148 can match the upper press-fit hook 122 of the top cover 120 and the lower press-fit hook 132 of the bottom cover 130, the present invention does not limit the number of the press-fit holes 148.

Refer to FIG. 2B again. In one embodiment, the bottom cover 130 further comprises a press-fit slot 133, and a rib 147 protrudes from the positioning member 146 of the terminal holder 140, whereby the top cover 120 and the bottom cover 130 can be assembled to the terminal holder 140 via sliding the press-fit slot 133 of the bottom cover 130 along the rib 147. Such a structure design makes the integrated top cover 120 and bottom cover 130 be firmly secured to the terminal holder 140.

Figure 3:
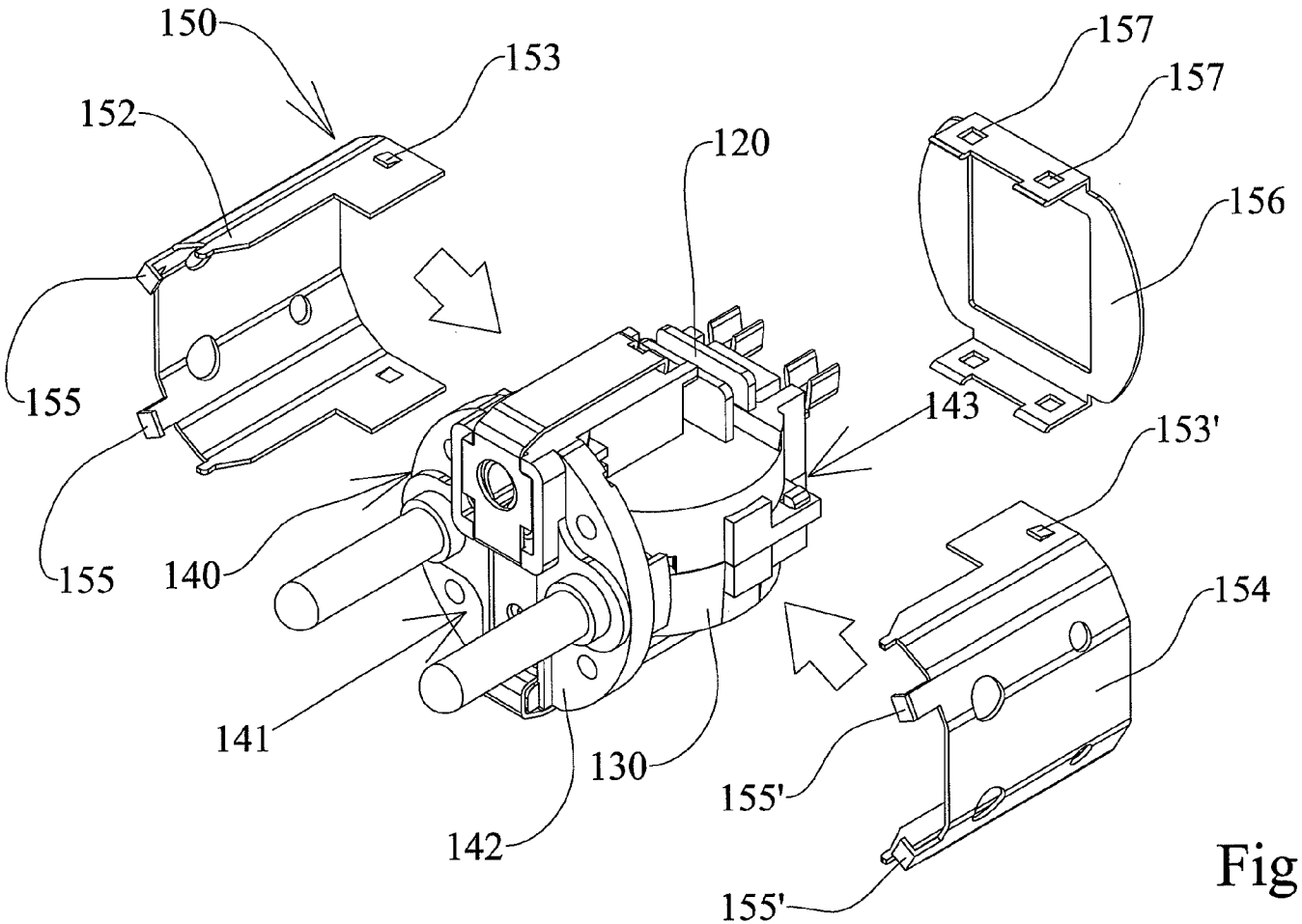

As shown in FIG. 3, a metal shell 150 covers the assembled top cover 120, bottom cover 130 and terminal holder 140 with a portion of the front face 141 of the plate 142 of the terminal holder 140 being exposed. In one embodiment, the metal shell 150 further comprises at least two side metal shells 152 and 154 covering the top cover 120 and the bottom cover 130 from two sides thereof. The metal shell 150 may further comprise a rear metal plate 156. In one embodiment, the rear metal plate 156 has an opening. However, the present invention does not demand that the rear metal plate 156 must have an opening. The rear metal plate 156 is assembled to the rear side of the top cover 120 and the bottom cover 130 to press-fit with the side metal shells 152 and 154 and cover a portion of the surfaces of the top cover 120 and bottom cover 130. In one embodiment, the side metal shells 152 and 154 respectively have a plurality of protrusions 153 and a plurality of press-fit protrusions 153', and the rear metal plate 156 has a plurality of press-fit holes 157. The press-fit holes 157 of the rear metal plate 156 can press-fit with the protrusions 153 and 153' of the side metal shells 152 and 154. In one embodiment, the side metal shells 152 and 154 respectively have bent portions 155 and 155'. In assemblage, the side metal shells 152 and 154 are secured to the front face 141 of the terminal holder 140 via the bent portions 155 and 155'.

Figure 4:
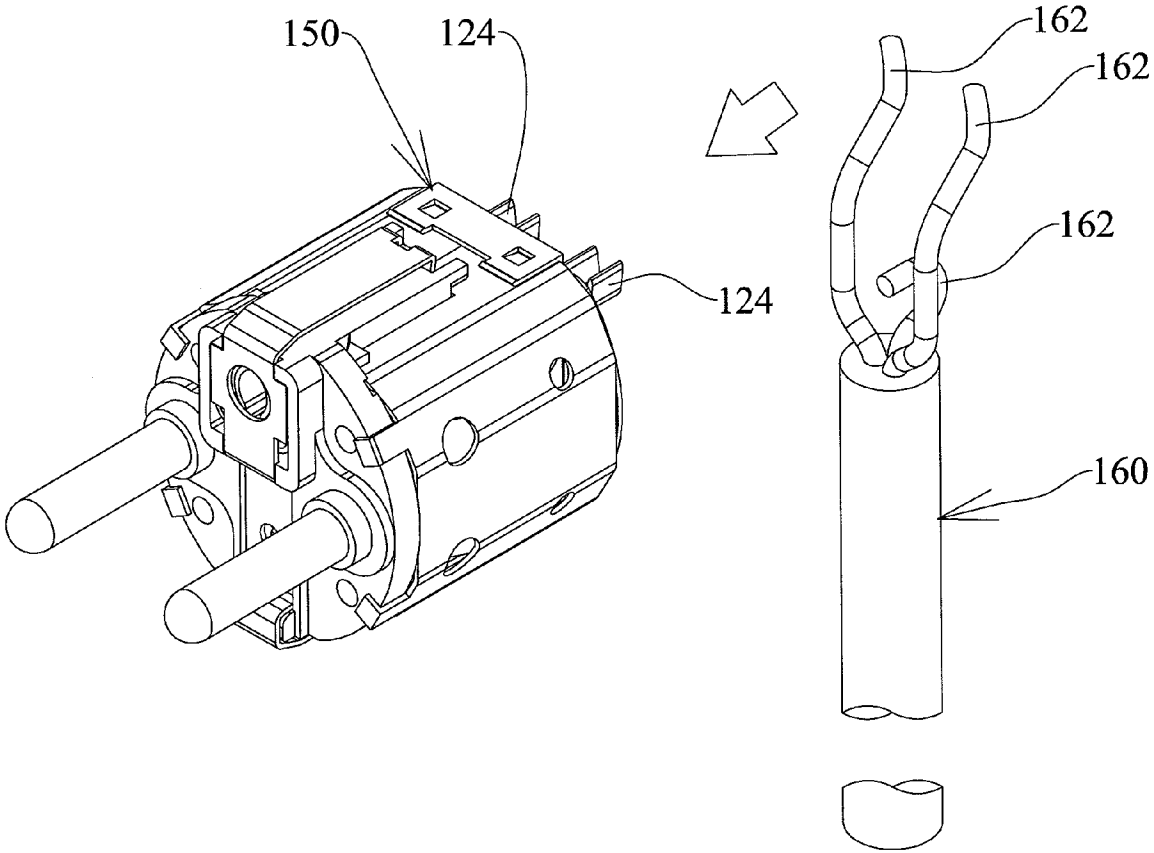

Refer to FIG. 4 a diagram schematically showing the semi-product of the power plug structure after the metal shell has been assembled. The metal shell 150 has an advantage of easy assemblage and has a function of shielding off electromagnetic interference. Next, a cable 160 having a plurality of wires 162 is assembled to the power plug structure after the metal shell 150 has been assembled. Each wire 162 is electrically connected with an arbitrary one of the wire grippers 124. In one embodiment, the wire 162 is connected with the wire gripper 124 with a riveting method to effectively increase the efficiency of fabrication.

Figure 5A:
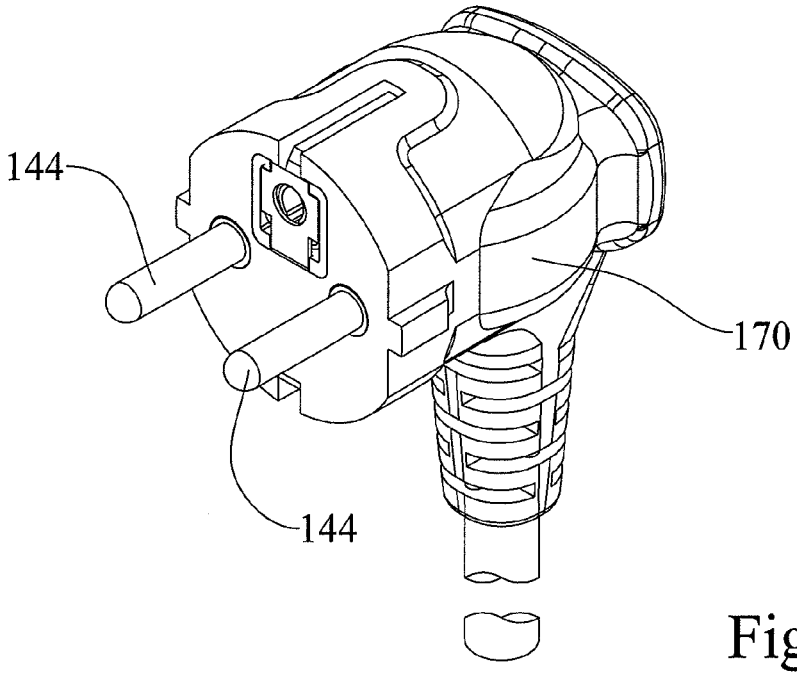
FIG. 5A and FIG. 5B are diagrams schematically a power plug structure according to one embodiment of the present invention.
Figure 5B:
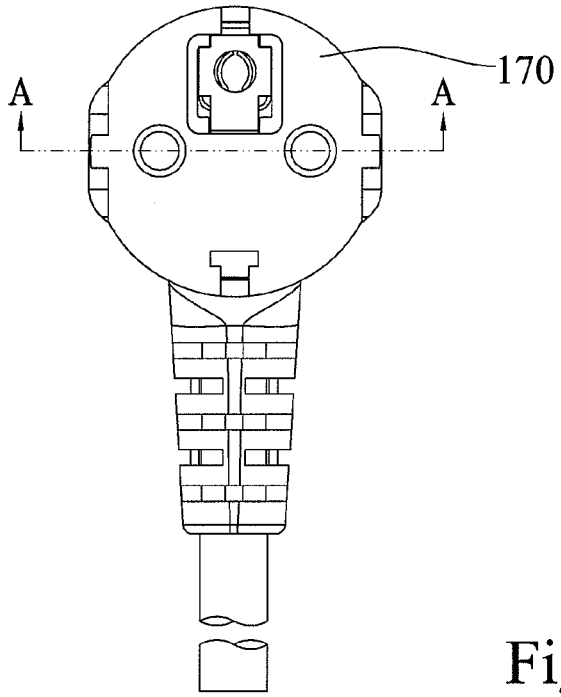

Refer to FIG. 5A and FIG. 5B. After the wires 162 have been assembled well, an insulating plastic shell 170 wraps the above-mentioned components with the electric-conduction terminals 144 being exposed. Thus is formed the power plug structure shown in FIG. 5A and FIG. 5B. The power plug structure shown in FIG. 5A is only one embodiment of the present invention. Any embodiments described in the specification are only to exemplify the present invention but not to limit the scope of the present invention. The technical characteristics of the present invention also apply to the power plug structures of the safety standards of other nations, such as China, USA, Canada, Swiss, Australia, Israel, etc.

Figure 5C:
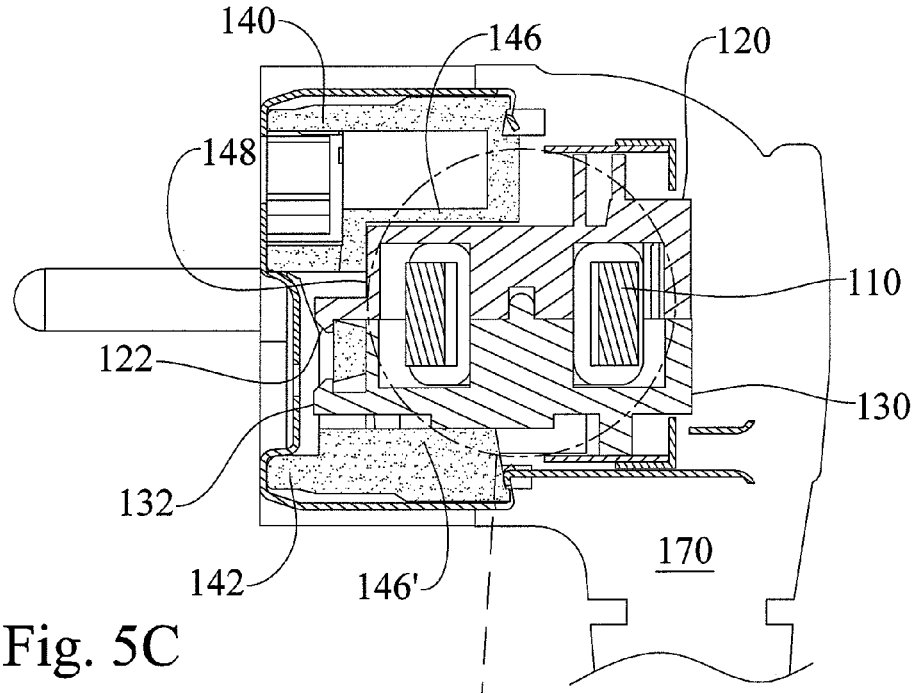
FIG. 5C is a sectional view along Line AA in FIG. 5B.

FIG. 5C is a sectional view along Line AA in FIG. 5B. The upper press-fit hook 121 of the top cover 120 and the lower press-fit hook 132 of the bottom cover 130 respectively pass the press-fit holes 148 of the terminal holder 140 to anchor on the terminal holder 140. In one embodiment, there are two positioning members 146 and 146' respectively vertically arranged on the rear face 143 of the plate 142. After assemblage, the top cover 120 and the bottom cover 130 are interposed between the two positioning members 146 and 146'. As shown in the drawings, the two positioning members 146 and 146' respectively press against the backsides of the top cover 120 and the bottom cover 130 lest the top cover 120 and the bottom cover 130 be separated by the pressure of plastic injection. Thereby, the loop inductor 110 is more effectively protected, and the reliability of the power plug structure is increased.

Figure 5D:
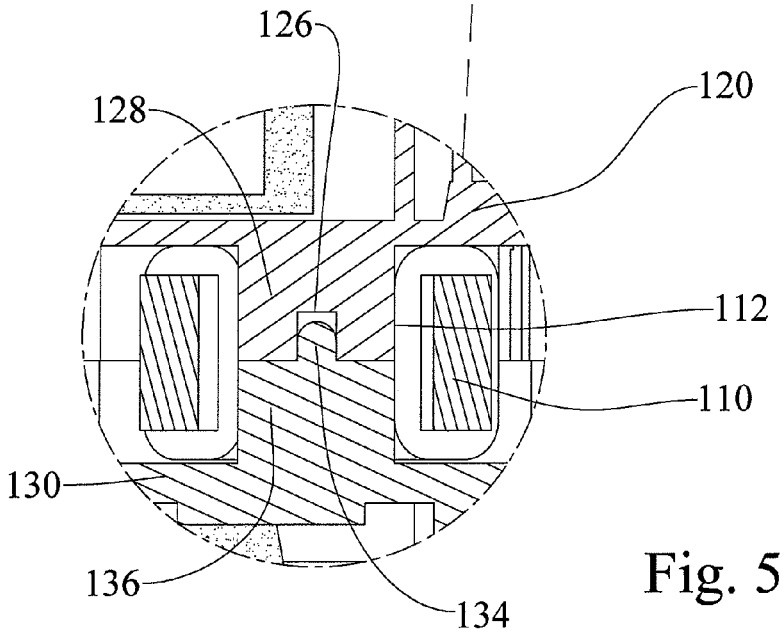
FIG. 5D is a partially enlarged view of FIG. 5C.
Figure 6:
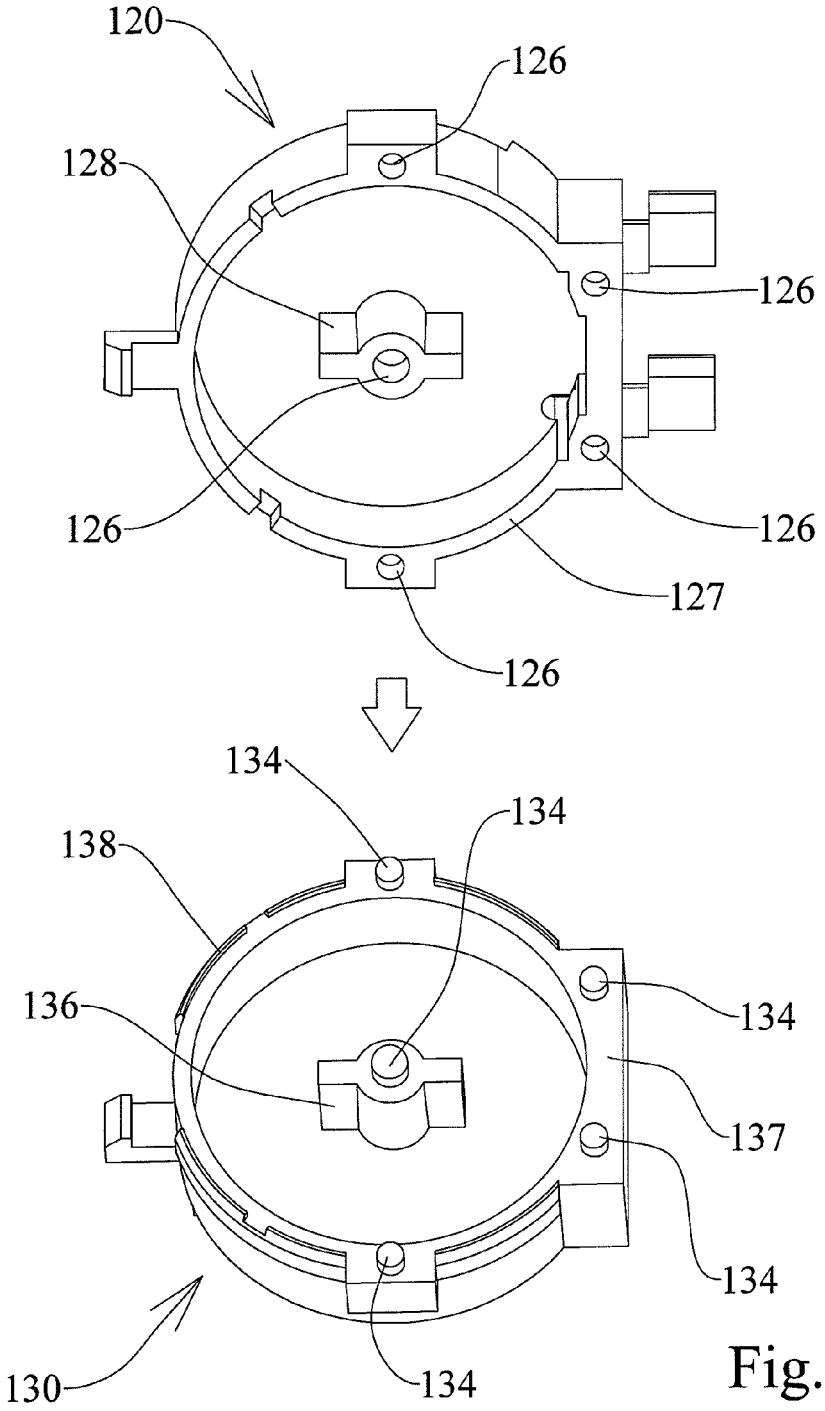
FIG. 6 is a diagram schematically showing a top cover and a bottom cover according to one embodiment of the present invention.

In the abovementioned embodiments, it is described: the top cover 120 and the bottom cover 130 are press-fitted to encase the loop inductor 110; the press-fitted top cover 120 and bottom cover 130 is then press-fitted to the terminal holder 140. However, how to press-fit the top cover 120 and the bottom cover 130 has not yet been described hereinbefore. Below will be described the press-fit mechanism of the top cover 120 and the bottom cover 130. Refer to FIG. 6. A plurality of positioning protrusions 134 are formed along the rim 137 and/or in the accommodation space of the bottom cover 130. The top cover 120 has a plurality of positioning recesses 126 corresponding to the positioning protrusions 134. Thereby, the top cover 120 and the bottom cover 130 can be press-fitted to each other via the positioning protrusions 134 and the positioning recesses 126. Refer to FIG. 5D a partially-enlarged view of FIG. 5C. In one embodiment, the positioning protrusion 134 in the accommodation space of the bottom cover 130 is arranged on a first pillar 136. The first pillar 136 protrudes from the interior of the bottom cover 130 and extends upward to pass through the hollow portion 112 of the loop inductor 110 to make the positioning protrusion 134 press-fit to the positioning recess 126 of the top cover 120. In this embodiment, the positioning recess 126 is arranged on a second positioning pillar 128. It should be understood that the positions of the positioning protrusions and the positioning recesses can be exchanged. In one embodiment, both the top cover 120 and the bottom cover 130 have positioning protrusions and positioning recesses at the same time. No matter how the positioning protrusions and positioning recesses are arranged in the above-mentioned embodiments, the top cover and the bottom cover can always be press-fitted to each other.

Refer to FIG. 6 again. In one embodiment, the top cover 120 or the bottom cover 130 has a flange along the outer side of the rim. Herein, the flange 138 on the bottom cover 130 is used as an exemplification. When the top cover 120 is press-fitted to the bottom cover 130, the rim 127 of the top cover 120 is also press-fitted to the inner face of the flange 138. Such a design can assist in the positioning of the positioning protrusions.

One characteristic of the present invention is that the electronic components of the loop inductor are integrated with the circuit inside the power plug structure. No matter whether the fluctuation of the power originates from the power supply network or is caused by the loads in the local network, the high impedances and magnetic fluxes induced by the common mode current of the AC circuit would be counterbalanced in the magnetic ring of the loop inductor. Therefore, the present invention can inhibit noise interference and electromagnetic interference and can prolong the service life of electronic devices and electric appliances. Another characteristic of the present invention is that a plurality of positioning protrusions and a plurality of positioning recesses corresponding to the positioning protrusions are formed on the top cover and the bottom cover to assist in the positioning of the top over and the bottom cover. Further, the backside of the bottom cover has press-fit slots matching the ribs of the terminal holder to guide the top cover and the bottom cover to be fast and precisely assembled to the terminal holder. Furthermore, the multiple side metal shells can be easily assembled to achieve a superior fixing effect without using any additional auxiliary.

In conclusion, the present invention proposes a power plug structure, which can be easily assembled via integrating a top cover, a bottom cover and a terminal holder in an insertion way, and which has higher structural reliability and can effectively protect the loop inductor.

The embodiments described above are to exemplify the present invention and demonstrate the technical thoughts and characteristics of the present invention to make the persons skilled in the art able to understand, make, and use the present invention. However, the embodiments are not intended to limit the scope of the present invention. Any equivalent modification or variation according to the spirit of the present invention is to be also included within the scope of the present invention.

What is claimed is:

1. A power plug structure comprising a loop inductor having a hollow portion;

a top cover and a bottom cover vertically press-fitted to each other to form an accommodation space to encase said loop inductor, wherein at least one wire gripper and an upper press-fit hook respectively extend out from different outer sides of said top cover;

a lower press-fit hook extending out from an outer side of said bottom cover;

said upper press-fit hook and said lower press-fit hook are arranged corresponding to each other; and an opening of said upper press-fit hook and an opening of said lower press-fit hook are arranged in a back-to-back way or a face-to-face way;

a terminal holder having a plate, wherein a plurality of electric-conduction terminals protrudes from a front face of said plate; at least one positioning member is formed on a rear face of said plate and extends out with an angle existing between said positioning member and said plate; a group of press-fit holes penetrating said plate; and said top cover and said bottom cover are pushed toward said rear face of said plate to insert said upper press-fit hook and said lower press-fit hook into said group of press-fit holes so as to integrate said top cover and said bottom cover with said plate;

a metal shell covering said top cover and said bottom cover with a portion of said front face of said plate of said terminal holder being exposed; and a cable having a plurality of wires each electrically connected with an arbitrary one of said wire grippers.

2. The power plug structure according to claim 1, wherein said wire gripper and said upper press-fit hook are respectively arranged at a rear lateral and a front lateral of said top cover.

3. The power plug structure according to claim 1, wherein said top cover or said bottom cover has a flange along an outer side of said rim thereof, and when said top cover is press-fitted to said bottom cover, a rim of said top cover or said bottom cover is press-fitted to an inner face of said flange of said bottom cover or said top cover.

4. The power plug structure according to claim 1 further comprising an insulating plastic shell covering said metal shell and said cable with said electric-conduction terminals being exposed.

5. The power plug structure according to claim 1, wherein a backside of said bottom cover has a press-fit slot.

6. The power plug structure according to claim 5 further comprising a rib protruding from said positioning member of said terminal holder, whereby said top cover and said bottom cover is assembled to said terminal holder via sliding said press-fit slot of said bottom cover along said rib.

7. The power plug structure according to claim 1, wherein said terminal holder has two said positioning members arranged on said rear face of said plate; and said top cover and said bottom cover are interposed between two said positioning members after said top cover and said bottom cover are assembled to said plate.

8. The power plug structure according to claim 7, wherein said positioning members respectively press against backsides of said top cover and said bottom cover.

9. The power plug structure according to claim 1, wherein said metal shell further comprises at least two side metal shells respectively covering said top cover and said bottom cover from a left side and a right side of said terminal holder.

10. The power plug structure according to claim 9 further comprising a rear metal plate, wherein said rear metal plate is pushed toward a rear side of said terminal holder to press-fit with said side metal shells and cover a portion of a surface of said top cover and a portion of a surface of said bottom cover.

11. The power plug structure according to claim 1, wherein said top cover or said bottom cover further comprises a plurality of positioning protrusions along a rim thereof and/or in an accommodation space thereinside.

12. The power plug structure according to claim 11, wherein said bottom cover or said top cover further comprises a plurality of positioning recesses; and said top cover and said bottom cover can be press-fitted to each other via press-fitting said positioning protrusions to said positioning recesses.

13. The power plug structure according to claim 11, wherein said top cover or said bottom cover has said positioning protrusions in said accommodation space thereof and said positioning protrusions in said accommodation space are arranged on first pillars; and said first pillars pass said hollow portion of said loop inductor to make said positioning protrusions of said top cover or said bottom cover press-fit with said positioning recesses of said bottom cover or said top cover.

14. The power plug structure according to claim 13, wherein said positioning recesses are arranged on second pillars of said bottom cover or said top cover.

* * * * *